US009049913B2

(12) United States Patent
Chan

(10) Patent No.: US 9,049,913 B2
(45) Date of Patent: Jun. 9, 2015

(54) STYLING BRUSH WITH SPINNING ATTACHMENT

(75) Inventor: Hon Hung Joseph Chan, Hong Kong (CN)

(73) Assignee: Conair Corporation, Stamford, CT (US)

( * ) Notice: Subject to any disclaimer, the term of this patent is extended or adjusted under 35 U.S.C. 154(b) by 272 days.

(21) Appl. No.: 13/041,758

(22) Filed: Mar. 7, 2011

(65) Prior Publication Data

US 2011/0220141 A1 Sep. 15, 2011

Related U.S. Application Data

(60) Provisional application No. 61/311,983, filed on Mar. 9, 2010.

(51) Int. Cl.

| | |
|---|---|
| ***A45D 1/04*** | (2006.01) |
| ***A45D 1/18*** | (2006.01) |
| *A45D 1/10* | (2006.01) |
| *A45D 2/00* | (2006.01) |

(52) U.S. Cl.
CPC ... *A45D 1/04* (2013.01); *A45D 1/10* (2013.01); *A45D 1/18* (2013.01); *A45D 2/002* (2013.01)

(58) Field of Classification Search
USPC ..... 132/224, 225, 237, 238, 231, 229, 269, 132/271; 219/222, 225
See application file for complete search history.

(56) References Cited

U.S. PATENT DOCUMENTS

| | | | | |
|---|---|---|---|---|
| 3,973,528 | A * | 8/1976 | Walter et al. | 132/120 |
| 6,047,707 | A | 4/2000 | Johnson | |
| 7,044,139 | B2 * | 5/2006 | Tong | 132/225 |
| 8,237,089 | B2 * | 8/2012 | Legrain et al. | 219/225 |
| 2005/0236009 | A1 * | 10/2005 | Park | 132/224 |
| 2008/0011318 | A1 * | 1/2008 | Wong | 132/232 |
| 2008/0092915 | A1 * | 4/2008 | Chan | 132/232 |
| 2009/0114240 | A1 * | 5/2009 | Leung | 132/224 |
| 2010/0212684 | A1 * | 8/2010 | Han | 132/232 |
| 2011/0017225 | A1 * | 1/2011 | Devulapalli | 132/118 |

FOREIGN PATENT DOCUMENTS

| | | | |
|---|---|---|---|
| DE | 102012201740 | A1 * | 2/2012 |
| FR | 2913571 | A1 * | 9/2008 |
| FR | 2916944 | A1 * | 12/2008 |

OTHER PUBLICATIONS

DE102012201740A1 electrical heatable hair care,Feb. 2, 2012, whole document.*

* cited by examiner

*Primary Examiner* — Robyn Doan
(74) *Attorney, Agent, or Firm* — Carter, DeLuca, Farrell & Schmidt, LLP

(57) ABSTRACT

An apparatus (10) for styling hair includes first and second members (12, 14) operatively connected to each other and adapted for relative movement between a generally open condition to receive a length of hair and a generally approximated position to engage the length of hair and a brush (22) mounted relative to the first and second members (12, 14). The brush (22) is adapted for rotational movement about a longitudinal axis defined thereby to brush the length of hair when the first and second members (12, 14) are in the approximated condition. At least one, if not both, of the first and second members (12, 14) may include a heating element (58) for heat treating the length of hair.

18 Claims, 12 Drawing Sheets

STYLING BRUSH WITH SPINNING ATTACHMENT

CROSS-REFERENCE TO RELATED APPLICATIONS

This application claims priority to and the benefit of U.S. Provisional Application Ser. No. 61/311,983 filed Mar. 9, 2010.

BACKGROUND

1. Technical Field

The present disclosure relates to an apparatus for styling hair, and, more particularly, relates to a hair styling apparatus having enhanced versatility in styling, straightening and combing hair with or without heat treatment.

2. Background of the Related Art

Hair styling tools and devices are well known in the art and include heated combs, brushes, curlers and irons. Examples of these devices are disclosed in commonly assigned U.S. Pat. Nos. 7,490,615, 7,178,532, 7,082,949, 6,191,387 and U.S. Patent Publication Nos.: 2010/0180908 and 2005/0087205, the entire contents of each of these disclosures being hereby incorporated by reference herein. These devices or tools have proven to be quite effective for their intended uses.

SUMMARY

The present invention is directed to further improvements in hair styling devices. In accordance with one embodiment of the present invention, an apparatus for styling hair includes first and second members operatively connected to each other and adapted for relative movement between a generally open condition to receive a length of hair and a generally approximated position to engage the length of hair, and a brush mounted relative to the first and second members. The brush is adapted for rotational movement about a longitudinal axis defined thereby to brush the length of hair when the first and second members are in the approximated condition. At least one, if not both, of the first and second members may include a heating element for heat treating the length of hair.

The brush may be adapted to rotate in both first and second directions of rotation about the longitudinal axis. In one embodiment, the brush is mounted about a drive shaft disposed within the first member. The drive shaft is adapted for rotational movement about a longitudinal axis defined thereby to cause corresponding rotational movement of the brush. A motor may be associated with one of the first and second members for driving the drive shaft. A locking element may be mounted to the first member. The locking element may be dimensioned and adapted for movement between a secured position to secure the brush on the drive shaft and a release position to permit removal of the brush from the drive shaft.

In embodiments, the drive shaft is adapted to rotate in both first and second directions of rotation about the longitudinal axis defined thereby to cause corresponding rotational movement of the brush. A control switch permits selective user control of the rotational movement of the drive shaft. The control switch may have first and second positions to enable movement of the drive shaft in the first and second directions of rotation respectively. The control switch may have a third neutral position where the drive shaft remains stationary.

A bristle member may be mounted to one of the first and second members. The bristle members may have a plurality of spaced teeth to comb the length of hair. First and second bristle members may be mounted adjacent respective lateral sides of the one of the first and second members. The bristle member may be releasably mounted to the one of the first and second members.

A manually operated control is in electrical communication with the heating element. The control may be adapted to control a level of heat emitted by the heating element.

BRIEF DESCRIPTION OF THE DRAWINGS

Various embodiments of the present disclosure are described hereinbelow with references to the drawings, wherein.

DETAILED DESCRIPTION OF THE EMBODIMENTS

Figure 1A:
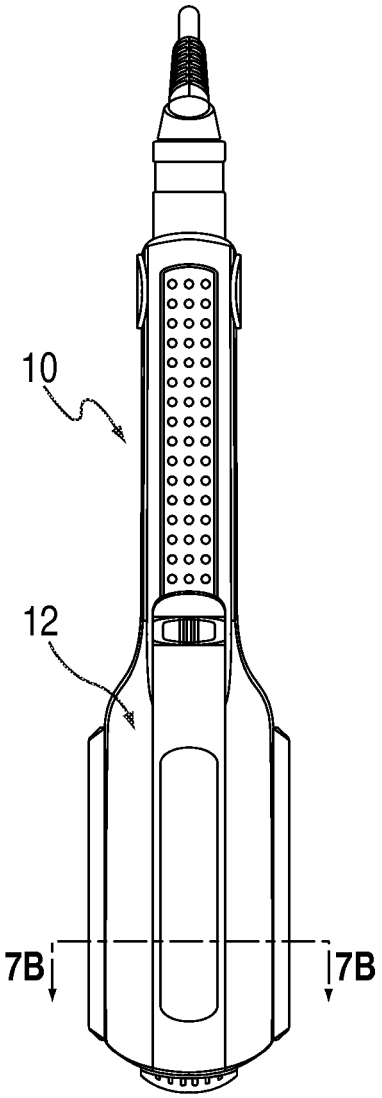
FIGS. 1A-1C are top, side and bottom plan views, respectively, of the apparatus for styling hair in accordance with the principles of the present invention.

Referring now to the drawings wherein like reference numerals identify similar components throughout the several views, FIGS. 1A-1C and FIGS. 2A-2B illustrate the apparatus for hair styling in accordance with the principles of the present disclosure. Hair styling apparatus 10 is extremely versatile permitting the operator to perform a variety of functions on a length of hair to achieve desired styling results. Apparatus 10 may incorporate heating elements and may be adapted to provide straightening, curling, brushing and/or combing functions either individually or concurrently.

Figure 1B:
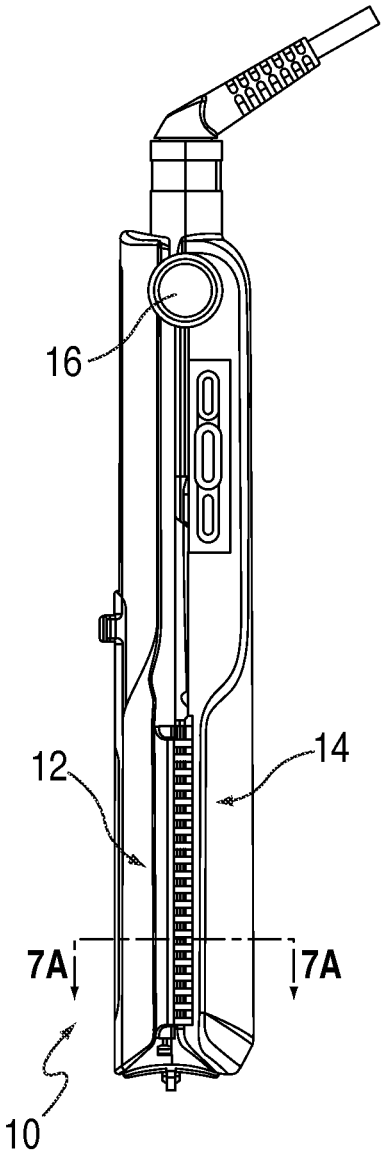
Figure 1C:
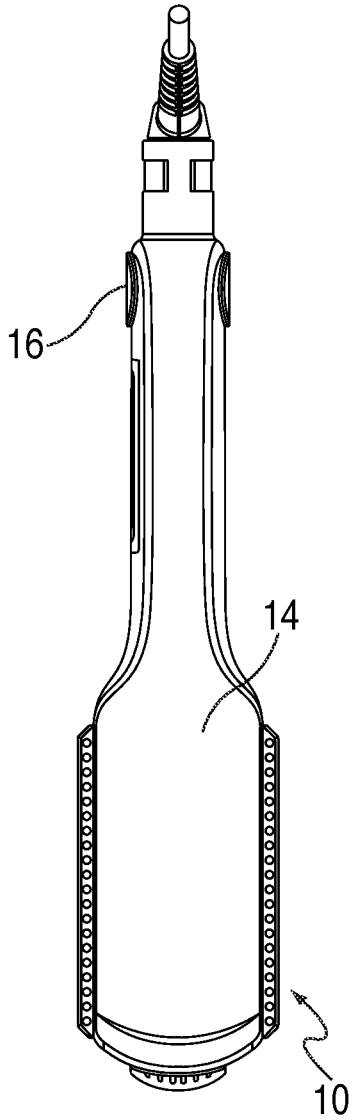
Figure 2A:
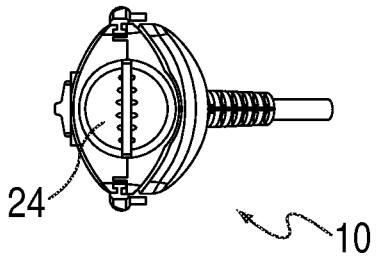
FIGS. 2A-2B are front and rear axial views, respectively, of the apparatus for styling hair.
Figure 2B:
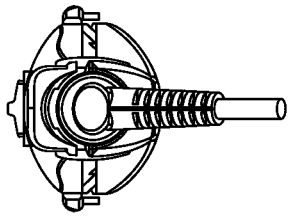
Figure 3A:
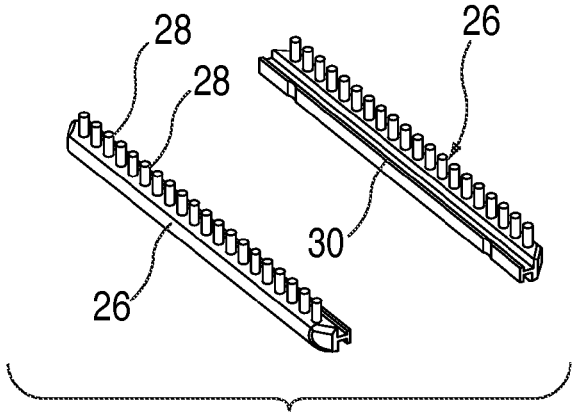
FIG. 3A is a perspective view of the elongated bristle members.
Figure 3:
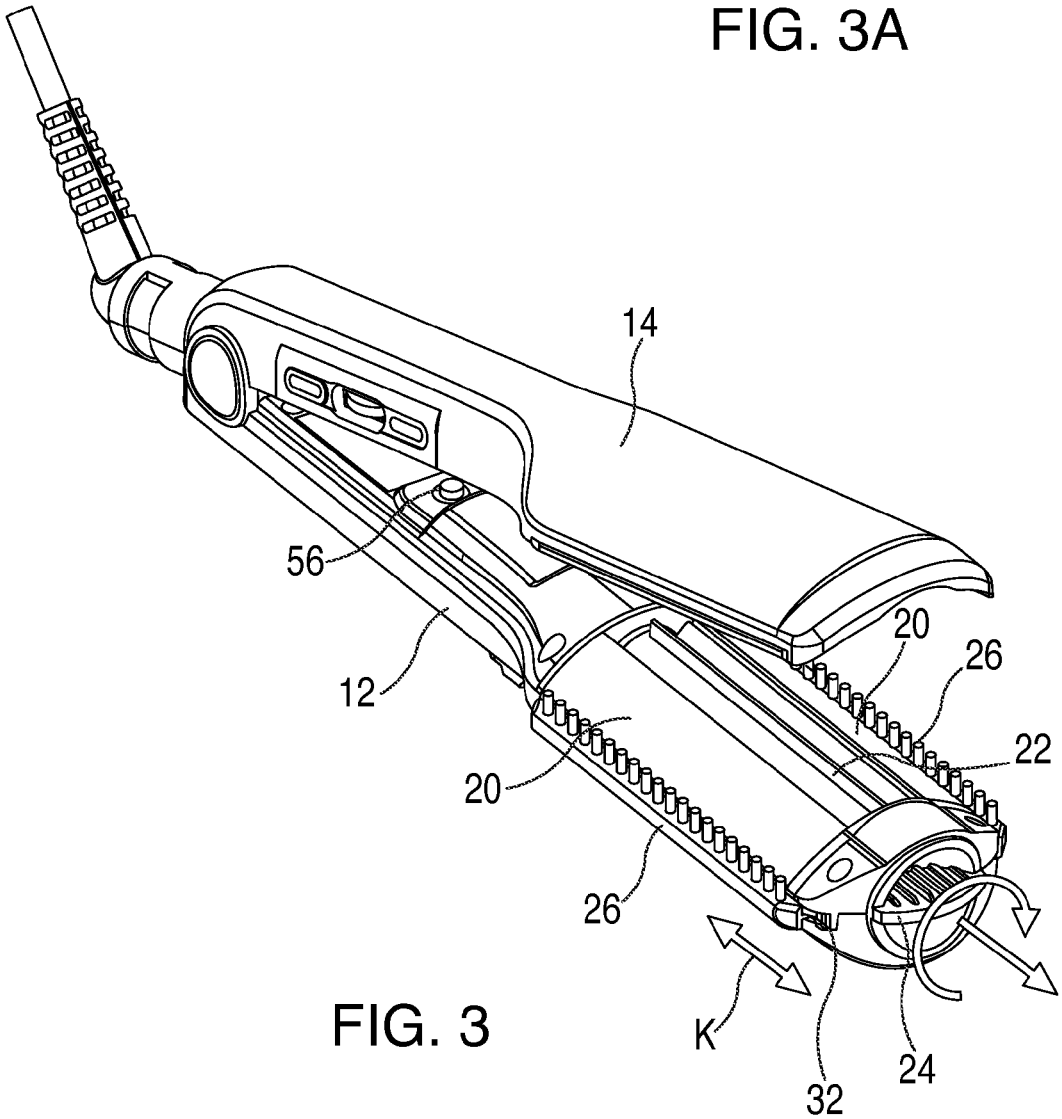
FIG. 3 is a perspective view of the apparatus for styling hair illustrating the first and second styling members in an open condition.

With reference now to FIG. 3, in conjunction with FIG. 1B, apparatus 10 includes first and second handles or hair styling members 12, 14 which are operatively connected to each other and adapted for relative movement between a substantially approximated condition of FIG. 1B and a substantially open condition of FIG. 3. In one embodiment, second styling number 14 is adapted to pivot about pivot element 16 between the approximated and closed conditions of apparatus 10; however, it is appreciated that first styling member 12 also may pivot either alone or in conjunction with second styling member 14 between the approximated and closed conditions.

First styling member 12 includes outer shell 18 and at least one heating plate 20 mounted to the outer shell 18 to transfer heat to the length of hair. In one embodiment, first styling member 12 incorporates a pair of opposed heating plates 20 one on each lateral side of the first styling member 12. Heating plates 20 may be planar, or, in the alternate, provide an arcuate profile, e.g., a concave arrangement, to impart some curvature or curled aspect to the length of hair. First styling member 12 further includes rotating brush element 22 at least partially disposed between the pair of heating plates 20, and a lock cap 24 for releasably securing the brush element 22 to the first styling member 12. Rotating brush element 22 and lock cap 24 will be discussed in further detail hereinbelow.

As best depicted in FIGS. 3 and 3A, first styling member 12 further includes a pair of elongated bristle or comb elements 26 mounted to the sides of outer shell 18 of the first styling member 12. Elongated bristle elements 26 each include a plurality of spaced teeth 28 dimensioned to comb the length of hair passing through the approximated first and second styling members 12, 14. Elongated bristle elements 26 may be releasably mounted to first styling member 12. In one embodiment, each bristle member 26 includes an inner rail 30, which is received within a correspondingly dimensioned longitudinal groove 32 within outer shell 18 of first styling member 12 to connect the components. (see also FIG. 7A). Inner rail 30 of elongated bristle member 26 is dimensioned to slide within longitudinal groove 32 in either direction as depicted by directional arrow "k" of FIG. 3 to permit the mounting and release of the elongated bristle member 26 relative to first styling member 12. Each inner rail 30 of elongate bristle members 26 may snap fit into its respective groove 32, or, in the alternative, establish a frictional relationship with the internal surfaces defining the grooves 32 to create a releasable coupling between the components.

Figure 4:
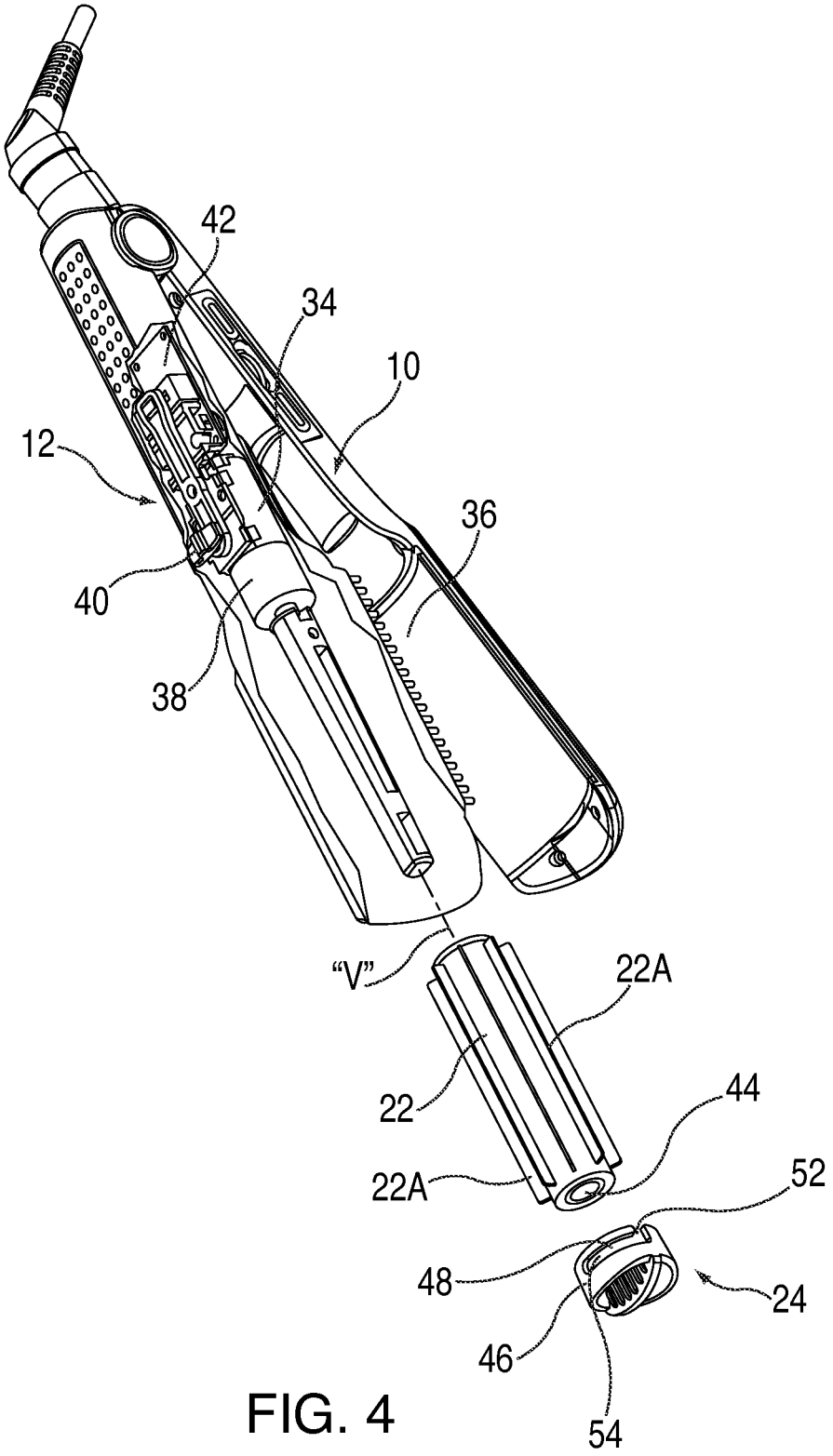
FIG. 4 is a perspective view of the apparatus for styling hair with parts separated and portions removed illustrating the internal components of the first styling member.

With reference now to FIG. 4 in conjunction with FIG. 3, first styling member 12 further includes motor 34, rotatable drive shaft 36 mechanically connected to the motor 34 through gear box 38, and brush element 22 which is mounted about the drive shaft 36. Motor 34 may be any conventional motor, e.g., a DC motor, adapted to impart rotational movement to drive shaft 36 through a mechanical cooperation with gear box 38. A manually operated rotation control switch 40 is in electrical communication with motor 34 to control operation of the motor 40 in conjunction with logic in the form of, e.g., a printed circuit board 42 or the like. Control switch 40 enables the rotation of rotatable drive shaft 36 in first and second directions about axis "v" of the drive shaft 36.

Rotatable brush element 22 is mounted about drive shaft 36 in a manner where rotational movement of the drive shaft 36 imparts corresponding rotational movement to the brush element 22. In one embodiment, drive shaft 36 defines a polygonal or non-circular cross-sectional dimension, which is received within a correspondingly dimensioned polygonal or non-circular internal bore 44 within brush element 22 to rotatably couple the components. Brush element 22 may comprise any suitable material. In on embodiment, brush element 22 includes a silicon layer or coating to facilitate passage through the hair and/or withstand the heat generated by the heating elements incorporated within first and second styling members 12, 14. Elongated brush element 22 may include bristles or blades 22*a* or the like to effect the desired brushing effect on the length of hair.

Figure 5A:
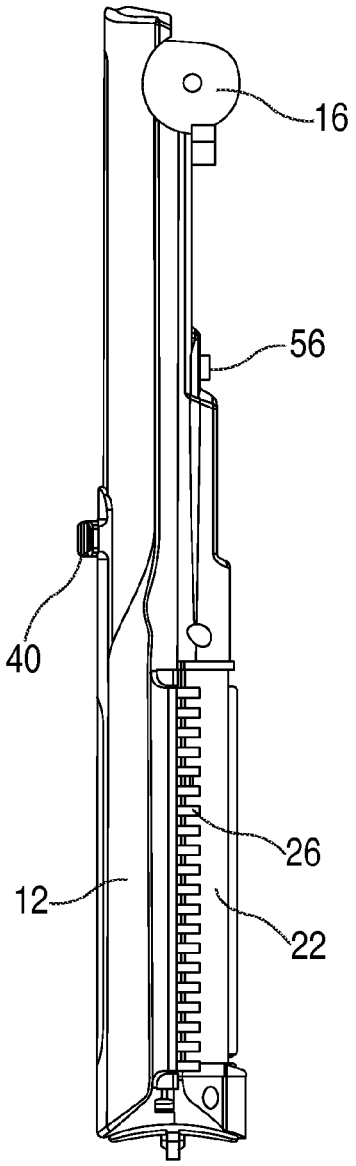
FIGS. 5A, 5B and 5C are side, bottom and axial plan views, respectively, of the first styling member of the apparatus for styling hair.
Figure 5B:
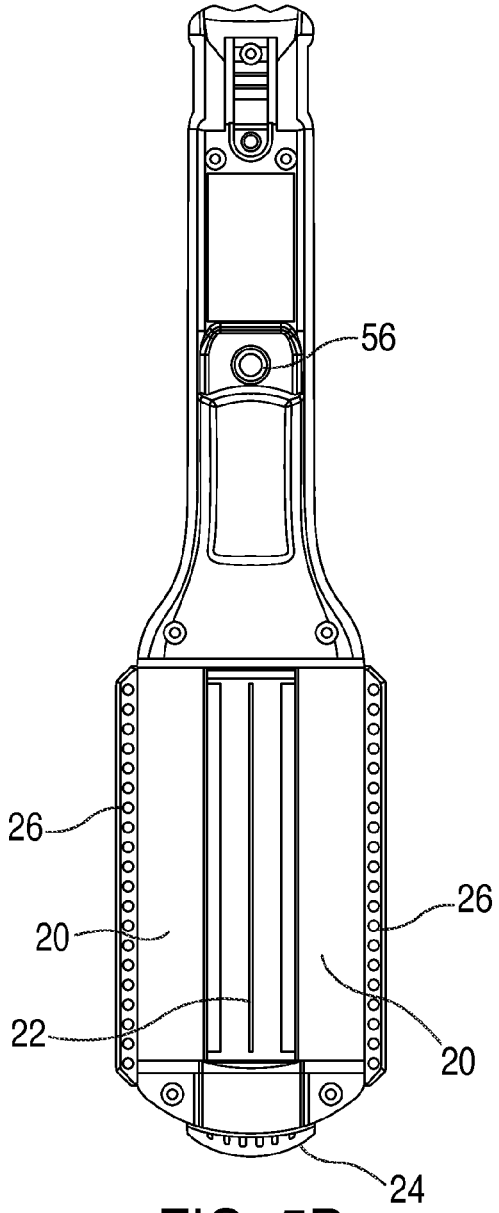
Figure 5C:
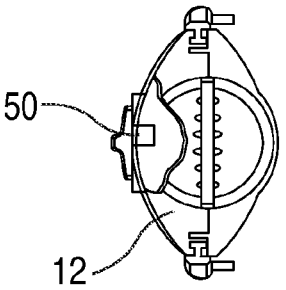

With reference now to FIGS. 3, 4 and 5A-5C, lock cap 24 defines circular base 46, which fits about the end of brush element 22. Base 46 defines bayonet slot 48 which receives a corresponding bayonet pin 50 (FIG. 5C) depending from the interior of outer shell 18 of first styling member 12 to releasably secure the lock cap 24 to the first styling member 12, thereby releasably securing brush element 22 to drive shaft 36. FIG. 5C illustrates portions of lock cap 24 removed to illustrate the internal bayonet pin 50 depending from the outer shell 18. In particular, lock cap 24 is reciprocally rotatable through an arc of about 90 degrees as depicted in FIG. 3 between secured and release positions. In the release position, bayonet pin 50 depending from outer shell 18 of first styling member 12 is in alignment with longitudinal slot segment 52 of bayonet slot 48. In this position, lock cap 24 may be mounted or removed relative to first styling member 12 thereby permitting corresponding mounting or removal of brush element 22 about drive shaft 36. The removal of brush element 22 facilitates cleaning of the brush element and removal of hair strands therefrom. Upon movement to the secured position of lock cap 24 effected by rotation of lock cap 24 through an angle of 90 degrees and corresponding traversal of bayonet pin 50 through transverse slot segment 54 of bayonet slot 48, the lock cap 24 is secured relative to first styling member 12, i.e., the bayonet pin 50 is retained within the transverse slot segment 54 of bayonet slot 48 to secure the lock cap 24 to the first styling member 12. Transverse slot segment 54 may have a defined recess to accommodate bayonet pin 50, and may be dimensioned to provide an audible click indicating lock cap 24 is in the secured condition.

First styling member 12 further includes electrical contact 56 on its inner surface. Contact 56 is in electrical communication with the control panel (to be discussed) of second styling member 14 and electrically engages a corresponding contact 56 of second styling member 14 to complete the circuit and activate the apparatus 10 when the first and second styling members are in the approximated condition and the apparatus is in the on condition. The electronic flow chart or circuit diagram will be discussed in greater detail hereinbelow.

Figure 6A:
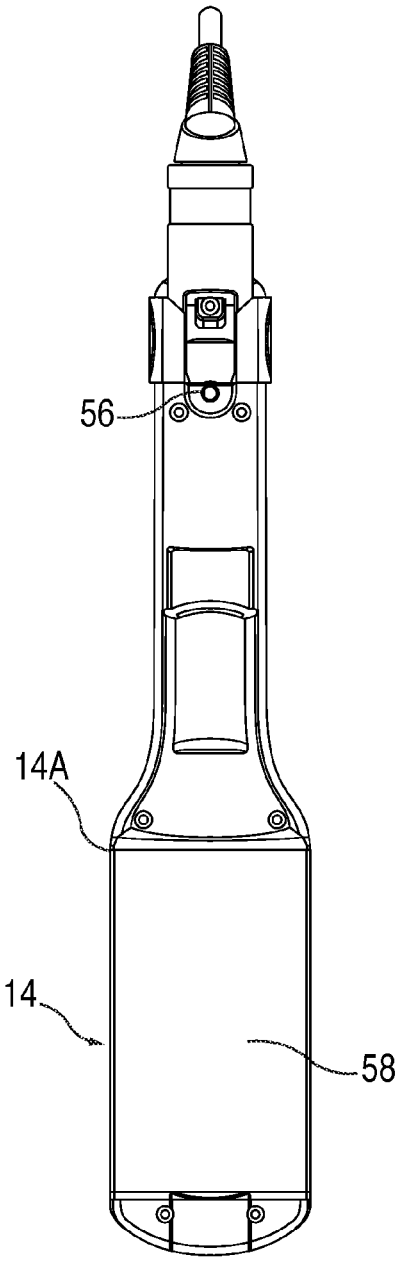
FIGS. 6A, 6B and 6C are side, bottom and axial plan views, respectively, of the second styling member of the apparatus for styling hair.
Figure 6B:
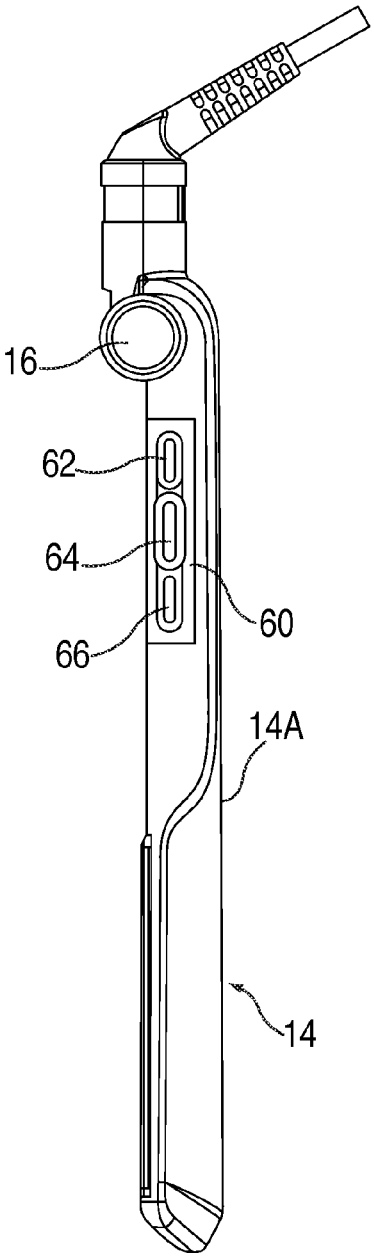
Figure 6C:
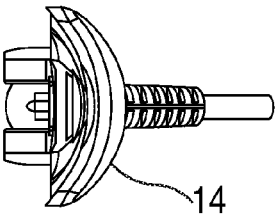

Referring now to FIGS. 6A-6C, second styling member 14 will be discussed. Second styling member 14 includes outer shell 14A and heating plate 58 mounted to the outer shell 14A in opposed relation to the heating plates 20 of first styling member 12. In one embodiment, heating plate 58 defines a generally concave contour which mates with the general convex arrangement of heating plates 20 of first styling member 12. Second styling member 14 may further include a control panel 60 incorporating a manual on/off switch 62 for activating the unit, a temperature dial 64 for controlling the temperature or heat conducted and/or generated by the heating elements associated with heating plates 20, 58 and a visual indicator 66 for indicating the activated condition of the apparatus. The temperature dial 64 may incorporate a variable resistor or rheostat to permit selective control of the temperature emitted by the heating elements associated with heating plates 20, 58. The visual indicator may be a light emitting diode (LED) or the like. As shown, electrical cord 68 is in electrical communication with control panel 60 and is adapted for connection to a power source, e.g., an AC power source. Contact 56 is also depicted in FIG. 6A which cooperates with contact 56 of first styling member 12 when in the approximated condition of first and second styling members 12, 14.

Figure 7A:
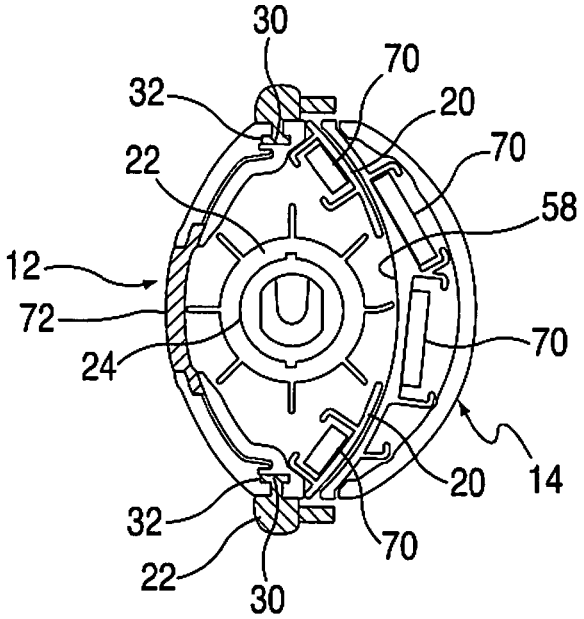
FIGS. 7A and 7B are each cross-sectional views of the apparatus for styling hair taken along the lines 7A-7A and 7B-7B, of FIGS. 1B and 1A, respectively.
Figure 7B:
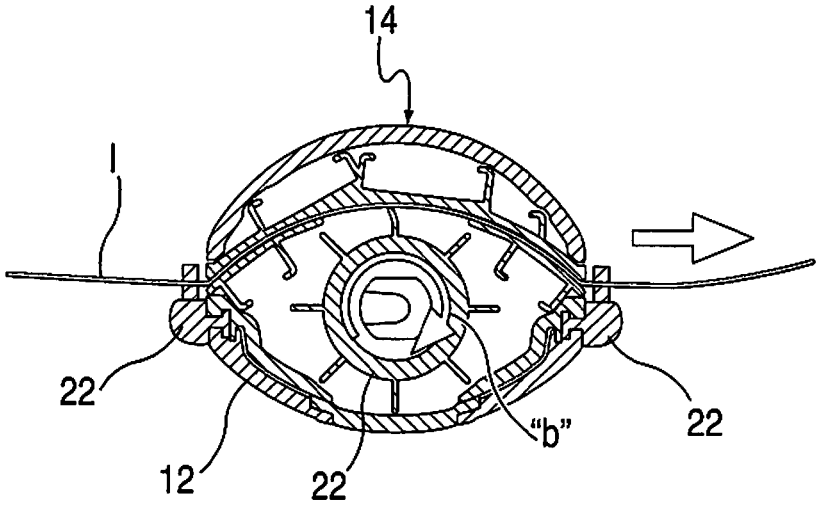

FIGS. 7A-7B are cross-sectional views taken through the center of the first and second styling members 12, 14 along respective lines 7A-7A and 7B-7B when in the approximated condition thereof. As shown, generally convex heating plates 20 of first styling member 12 are adjacent to and follow the corresponding contour of the generally concave surface of heating plate 58 of second styling member 14. Ceramic heaters 70 are positioned adjacent to, or in contact with, heating plates 20, 58 to convey heat to the heating plates 20, 58 for application to the length of hair "l". Ceramic heaters 70 are in electrical connection with control panel 60.

Figures 8A, 8B:
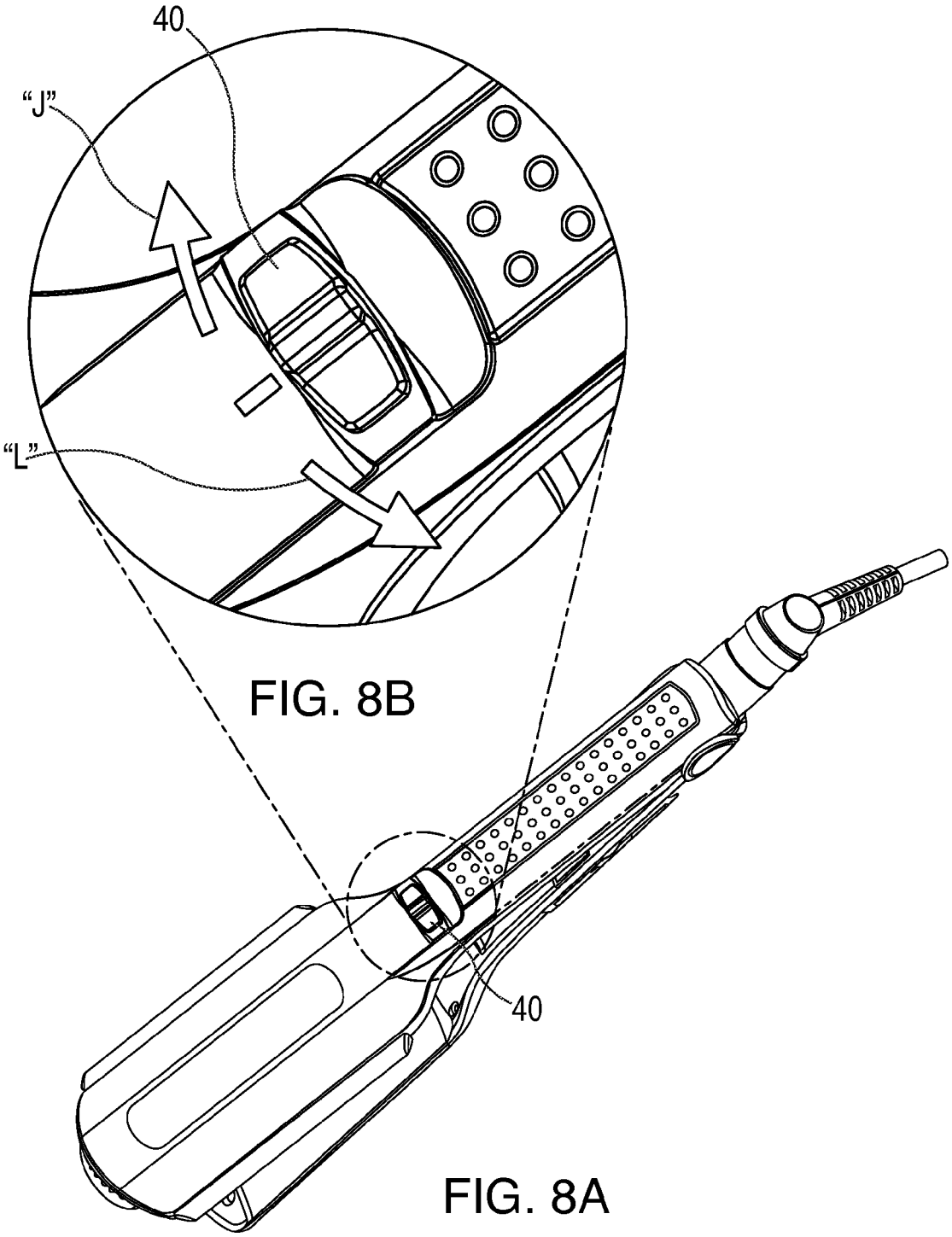
FIG. 8A is another perspective view of the apparatus for styling hair.
FIG. 8B is an enlarged view of the isolated area identified in FIG. 8A illustrating the motor control element.

As shown in FIG. 7B, brush element 22 can rotate in the direction of arrow "b" to treat the length of hair "l" extending through the first and second styling members 12, 14. The length of hair "l" is also passed through bristle elements 22 to effect a combing effect on the hair. As discussed hereinabove, brush element 24 may be rotated in a second direction opposite to the direction of arrow "b" if desired. FIGS. 8A-8B depict the movement of switch 40 for controlling operation of the motor 34 to effect either a clockwise or counterclockwise rotation of brush element 22. This alternating capability of rotational movement of brush element 22 may enhance versatility of the apparatus 10, and permit retrograde or reverse rotational movement in the event the length of hair "l" becomes entangled when rotating in a first direction.

Figure 9:
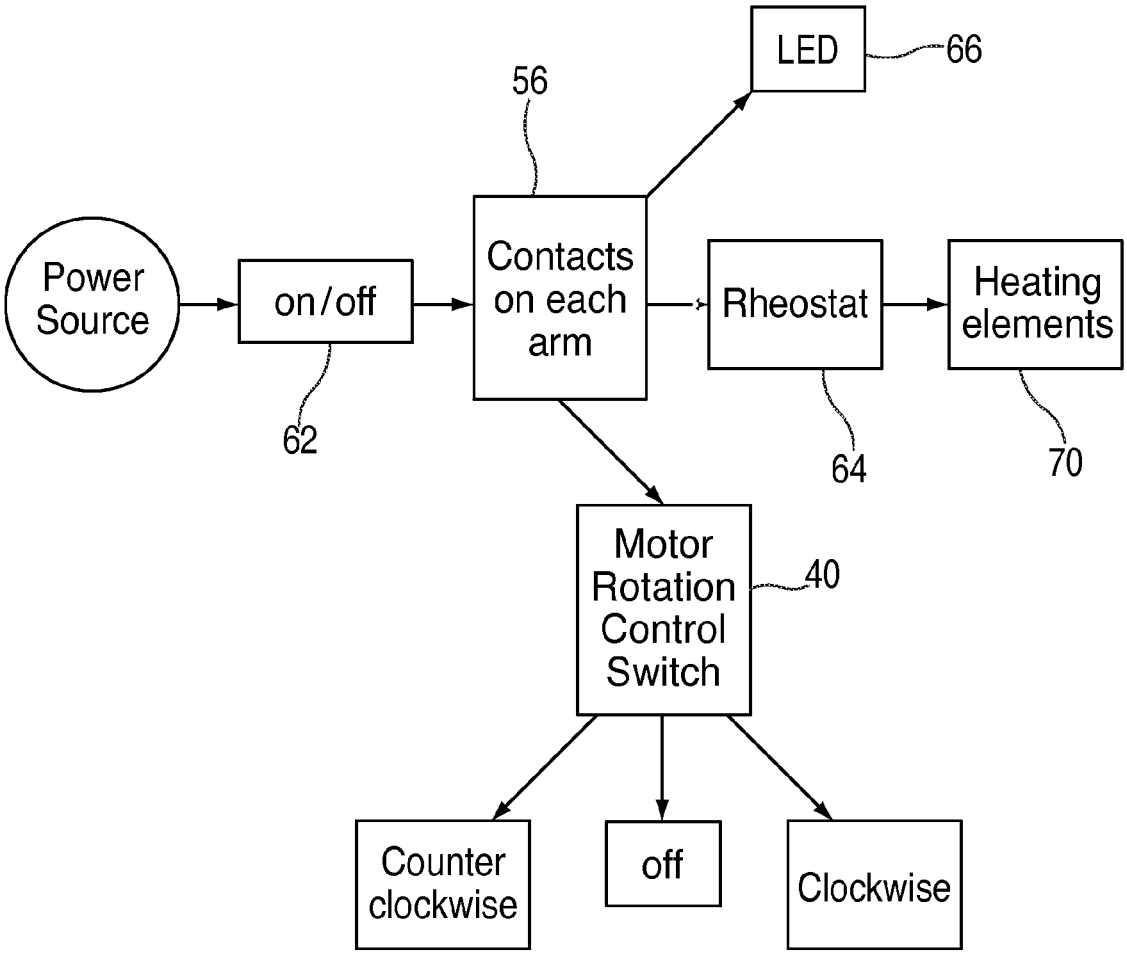
FIG. 9 is a flow or circuit diagram illustrating the electrical components of the apparatus for styling hair.

FIG. 9 is a circuit diagram illustrating operation of apparatus 10. As shown, the first step in the hair treating process is to activate the power source by activating the on/off switch 62. If first and second styling members 12, 14 are in an open condition, the circuit may remain open until the styling members 12, 14 are in the approximated condition upon which time the contacts 56 on each respective first and second styling members 12, 14 contact each other to complete the circuit. The LED visual indicator 66 may be illuminated. Thereafter, the operator may control heat directed to the ceramic heating elements 70 through manipulation of the temperature control dial/variable resistor 64.

With reference to FIGS. 8A-8B, in conjunction with FIG. 9, the motor rotation control switch 40 on the first styling member 14 may be moved to a first left most position following arrow "t" to activate the motor 34 in a manner to impart rotational movement to the drive shaft 36 and brush element 22 in a first or counter clockwise direction, moved to a second rightmost position following arrow "j" activate the motor 34 to impart rotational movement to the drive shaft 36 and the brush element 22 in a second clockwise direction, or moved to a neutral position (shown in FIG. 8B) when the drive shaft 36 and brush element 22 are not driven by the motor 34.

Figure 10:
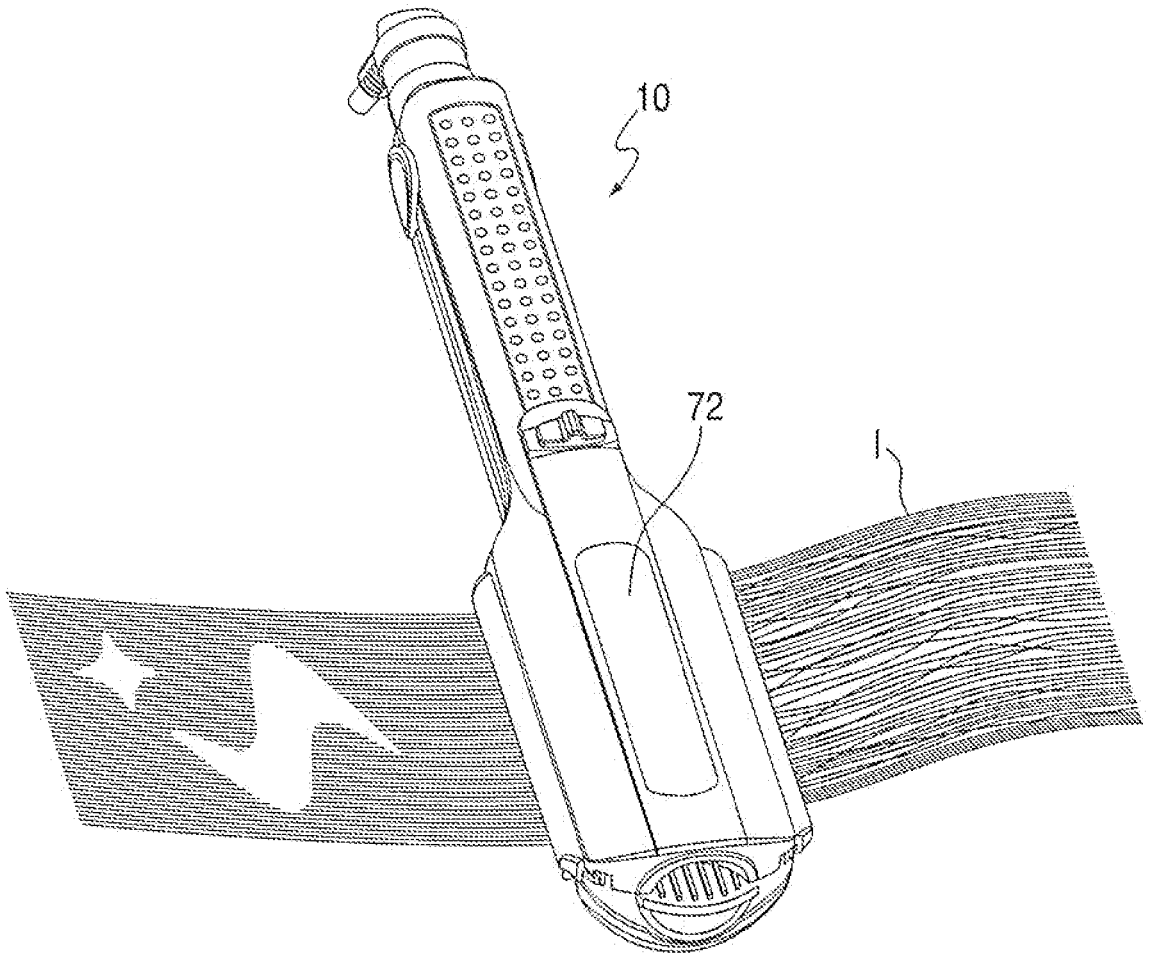
FIG. 10 is a perspective view illustrating the use of the apparatus in styling hair.

FIG. 10 illustrates use of apparatus 10 in treating or styling hair. As shown, outer shell 18 of first styling member 12 includes a transparent window 72 covered with Plexiglas or the like to permit viewing of the length of hair "l" as it passed through brush element 22.

Figure 11:
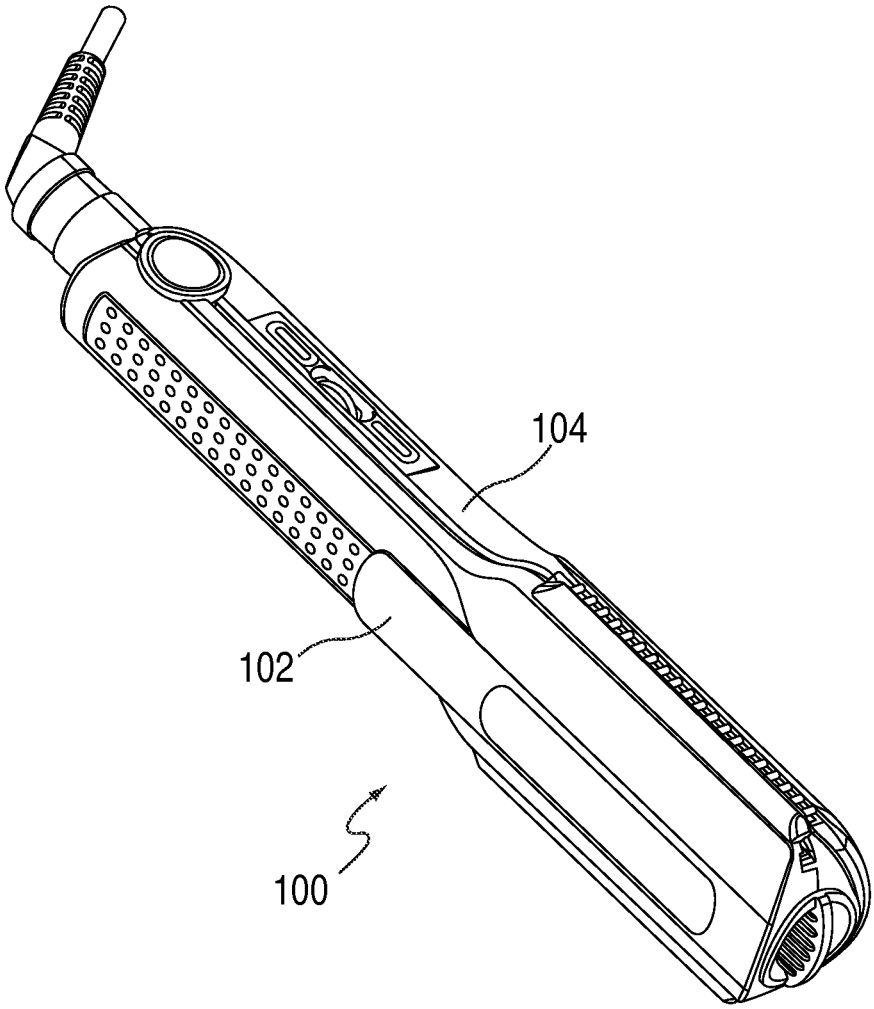
FIG. 11 is a perspective view of an alternate embodiment of the apparatus for styling hair of FIG. 1.
Figures 12A, 12B:
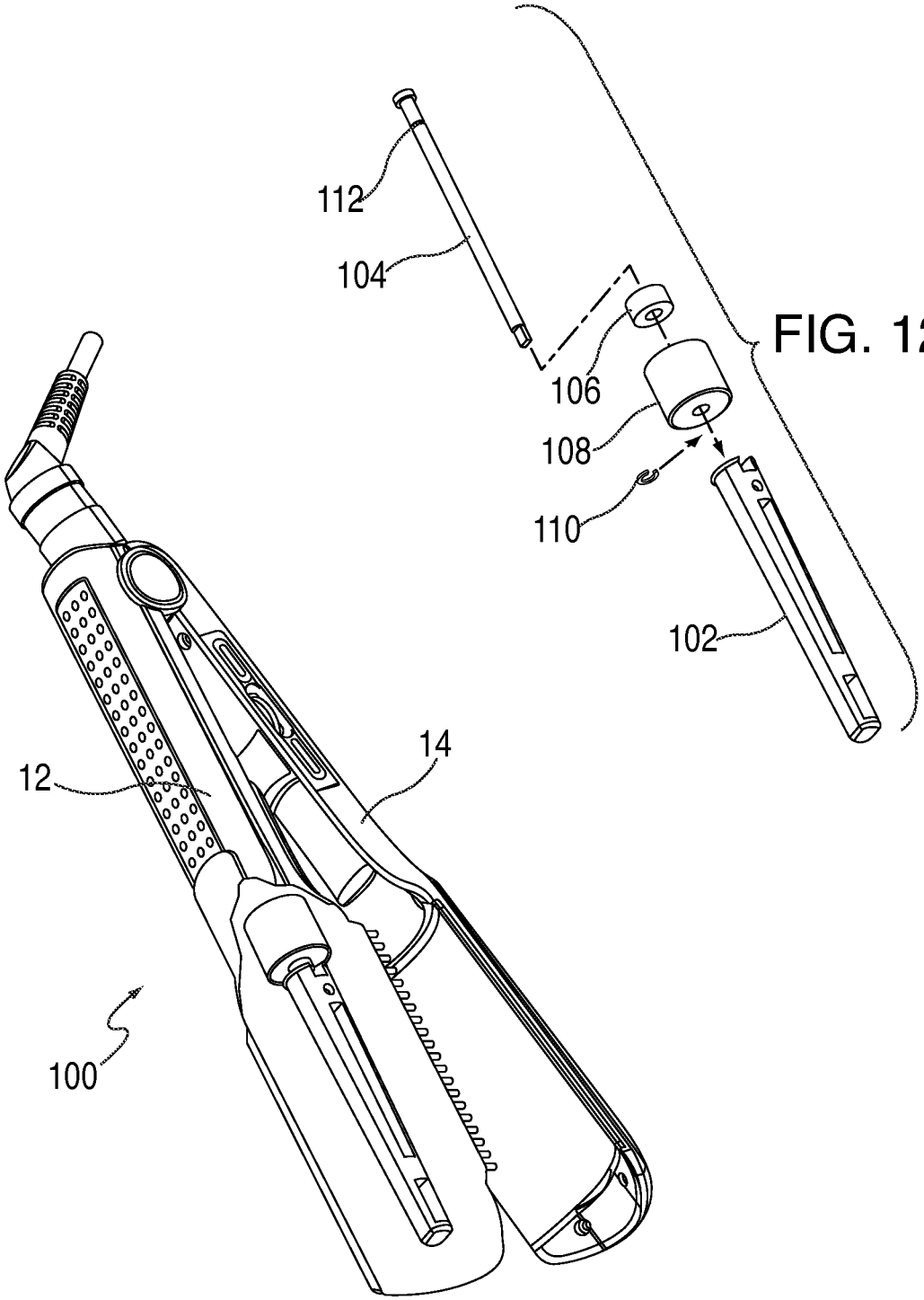
FIG. 12A is a perspective view of the apparatus for styling hair of FIG. 11 with portions removed illustrating the internal components of the first styling member.
FIG. 12B is a perspective view illustrating the components of the free spinning drive mechanism for permitting free rotational movement of the styling brush.

Referring now to FIGS. 11 and 12A-12B, another embodiment of the apparatus for styling hair is illustrated. In accordance with this embodiment, apparatus 100 is devoid of a motor to drive brush element 22 (not shown). Rather, brush element 22 is mounted to drive shaft 102 which may rotate freely about an inner shaft 104. For example, inner shaft 104 is supported by bearing 106 inside bearing bracket 108 and secured by c-clip 110. C clip 110 may engage corresponding groove 112 within inner shaft 104. Inner shaft 104 is secured with first styling member 12. With this arrangement, drive shaft 102 and thus brush element 22 may rotate freely upon passage of the length of the hair "l". In most other respects, apparatus 100 is substantially similar to the apparatus of FIGS.

Although the illustrative embodiments of the present disclosure have been described herein with reference to the accompanying drawings, the above description, disclosure, and figures should not be construed as limiting, but merely as exemplifications of particular embodiments. It is to be understood, therefore, that the disclosure is not limited to those precise embodiments, and that various other changes and modifications may be effected therein by one skilled in the art without departing from the scope or spirit of the disclosure.

What is claimed is:

1. An apparatus for styling hair, which comprises:

first and second members operatively connected to each other and adapted for relative movement between a generally open condition to receive a length of hair and a generally approximated condition to engage the length of hair, the first member having one of a locking pin or a locking slot;

a brush mounted about a drive shaft disposed within the first member, the drive shaft adapted for rotational movement about a longitudinal axis defined thereby to cause corresponding rotational movement of the brush to brush the length of hair when the first and second members are in the approximated condition;

a motor associated with one of the first and second members for driving the drive shaft; and a locking element releasably mounted to the first member, the locking element having the other of the locking pin or the locking slot, the locking element dimensioned and adapted for rotational movement about the longitudinal axis between a secured position where the locking pin is secured within the locking slot to secure the brush on the drive shaft and a release position where the locking pin is released from the locking slot to permit selective mounting and removal of the locking element and the brush relative to the drive shaft.

2. The apparatus according to claim 1 wherein at least one of the first and second members includes a heating element for heat treating the length of hair.

3. The apparatus according to claim 2 wherein each of the first and second members includes a heating element for heat treating the length of hair.

4. The apparatus according to claim 2 including a manually operated control in electrical communication with the heating element, the control adapted to control a level of heat emitted by the heating element.

5. The apparatus according to claim 1 wherein the drive shaft is adapted to rotate in both first and second directions of rotation about the longitudinal axis defined thereby to cause corresponding rotational movement of the brush.

6. The apparatus according to claim 5 including a control switch to permit selective user control of the rotational movement of the drive shaft, the control switch having first and second positions to enable movement of the drive shaft in the first and second directions of rotation respectively.

7. The apparatus according to claim 6 wherein the rotation control switch has a third neutral position where a drive shaft remains stationary.

8. The apparatus according to claim 1 including a window mounted to the first member and dimensioned and positioned to permit viewing of the length of hair during passing thereof along the brush.

9. The apparatus according to claim 1 including a bristle member mounted to one of the first and second members, the bristle member having a plurality of spaced teeth to comb the length of hair.

10. The apparatus according to claim 9 including first and second bristle members mounted adjacent respective lateral sides of the one of the first and second members.

11. The apparatus according to claim 9 wherein the bristle member is releasably mounted to the one of the first and second members.

12. The apparatus according to claim 1 wherein the locking element includes a lock cap defining a grip, at least a portion of the grip dimensioned to extend beyond the first and second members when in the approximated condition thereof.

13. The apparatus according to claim 1 wherein the locking element includes a lock cap, the lock cap adapted to reciprocally rotate about the longitudinal axis through an arc of rotation between the secured and release positions thereof.

14. The apparatus according to claim 13 wherein the lock cap includes the locking slot and the first member includes the locking pin.

15. An apparatus for styling hair, which comprises:

first and second members operatively connected to each other and adapted for relative movement between a generally open condition to receive a length of hair and a generally approximated condition to engage the length of hair;

a brush mounted about a drive shaft disposed within the first member, the drive shaft adapted for rotational movement about a longitudinal axis defined thereby to cause corresponding rotational movement of the brush to brush the length of hair when the first and second members are in the approximated condition;

a motor associated with one of the first and second members for driving the drive shaft; and a lock cap releasably mounted to the first member, the lock element dimensioned and adapted for rotational movement about the longitudinal axis between a secured position where cooperating locking structure of the first member and the lock cap secures the brush on the drive shaft, and a release position where the cooperating locking structure of the first member and the lock cap permit selective mounting and removal of the lock cap and the brush relative to the drive shaft.

16. The apparatus according to claim 15 wherein the cooperating structure includes a lock element and a lock recess.

17. The apparatus according to claim 16 wherein the lock element is a locking pin.

18. The apparatus according to claim 17 wherein the locking pin is mounted to the first member and the lock recess is associated with the lock cap.

* * * * *